US006187167B1

(12) United States Patent
Dartnell et al.

(10) Patent No.: US 6,187,167 B1
(45) Date of Patent: Feb. 13, 2001

(54) RECOVERY OF METAL FROM SOLUTION

(75) Inventors: Nicholas J. Dartnell, Harrow; Christopher B. Rider, New Malden; Bruce S. Gowans, Hemel Hempstead, all of (GB)

(73) Assignee: Eastman Kodak Company, Rochester, NY (US)

( * ) Notice: Under 35 U.S.C. 154(b), the term of this patent shall be extended for 0 days.

(21) Appl. No.: 09/347,157

(22) Filed: Jul. 2, 1999

(30) Foreign Application Priority Data

Jul. 13, 1998 (GB) ..... 9815167

(51) Int. Cl.[7] ..... C25B 15/02

(52) U.S. Cl. ..... 205/337; 204/228.1; 204/229.8; 204/230.2; 204/434; 204/275.1; 205/337; 205/82; 205/83; 205/96; 205/101; 205/263

(58) Field of Search ..... 205/337, 82, 83, 205/96, 101, 263

(56) References Cited

U.S. PATENT DOCUMENTS

| | | | | |
|---|---|---|---|---|
| 3,925,184 | | 12/1975 | Cave | 204/228.3 |
| 3,980,538 | | 9/1976 | Higgins | 205/337 |
| 4,018,548 | | 4/1977 | Berkowitz | 418/61.2 |
| 4,018,658 | * | 4/1977 | Alfin et al. | 204/228.1 |
| 4,619,749 | | 10/1986 | Nusbaum | 204/228.6 |
| 4,776,931 | | 10/1988 | Hardy | 205/337 |
| 5,310,466 | | 5/1994 | LaRiviere et al. | 204/229.2 |
| 5,951,842 | * | 9/1999 | Ueffinger | 205/337 |

FOREIGN PATENT DOCUMENTS

| | | |
|---|---|---|
| 0 201 837 | 3/1989 | (EP) . |
| 0 598 144 A1 | 5/1994 | (EP) . |
| 0 754 780 A1 | 1/1997 | (EP) . |
| 1 500 748 | 2/1978 | (GB) . |

* cited by examiner

*Primary Examiner*—Bruce F. Bell

(57) ABSTRACT

Recovery of silver from a photographic fixer solution in an electrolytic cell is controlled so as to maintain a high current efficiency whilst minimizing unwanted side effects. The rate of change of plating voltage at constant current through the cell is monitored, and in response to detection of a maximum value thereof the current is reduced to a new constant level. Such control allows the cell to be operated continually at high current efficiency in response to changing chemical conditions within the cell.

20 Claims, 3 Drawing Sheets

RECOVERY OF METAL FROM SOLUTION

FIELD OF THE INVENTION

The present invention relates to a method of, and apparatus for, controlling the recovery of metal from solution in an electrolytic cell by plating, (or deposition), onto an electrode thereof. The invention finds particular, though not exclusive, application in the recovery of silver from a photographic solution.

BACKGROUND OF THE INVENTION

For convenience the invention will be discussed, by way of example only, with reference to photographic solutions used in black and white processing.

Photographic material, in sheet or roll film form, is processed in several stages, including chemical development, fixing of the image, washing and drying. The role of the photographic fixing solution is to form soluble salts of any unexposed silver halide grains in the emulsion of the sensitized material. As more film is processed, the fixing solution becomes seasoned with soluble silver ion complexes. These complexes reduce the ability of the solution to fix the image, and may affect its final quality. Ultimately, in some instances the solution could become too loaded with silver and it would be necessary to replace it with a totally fresh solution. However, environmental legislation is increasingly putting stricter limitations on the disposal of waste material bearing silver. Consequently, attention is increasingly being paid to safe and efficient recovery of the silver, and it is known to do this electrolytically, either by recovery of silver from the effluent, which is then disposed of, or by in-line treatment in which silver-bearing solutions are withdrawn from a processing tank, passed through the electrolytic cell and returned to the tank. The advantages of in-line electrolytic recovery of the silver include:

(i) the lifetime of the fixing solution can be extended, (ii) the rate of fixing of the image can be increased, (iii) the rate of replenishment of the solution with fresh chemicals can be reduced, (iv) treatment of the effluent from the photographic processing is facilitated, (v) the value of the silver recovered is economically worthwhile, and (vi) reduced carryover of silver into the wash, with consequent lower silver concentration in the wash effluent.

As with any electrochemical process, however, poor control of the recovery of silver can do more harm than good. When a silver recovery cell is operated efficiently, the only cathodic reaction that occurs is the reduction of silver ions to silver metal, and this is controlled by the potential at this electrode. If too high a potential is applied, then side reactions can occur which lead to the production of unwanted by-products, for example silver sulphide can be formed as a fine precipitate in the solution (sulphiding). The recovery of the silver is often, therefore, a compromise between high rates of silver plating at higher currents, and consequentially at higher potentials, and safe operation. Large scale silver recovery units commercially available employ a third electrode (most commonly a reference electrode, but it may be a pH electrode) or a silver sensor, in order to maintain the efficiency of the operation and to avoid unwanted side reactions. However, these components increase the cost, and problems can arise with calibration of the equipment and electrical drift of the settings. It is possible, however, with the reference electrode, for example, to limit the cathode potential such that the potential for the formation of silver sulphide is not exceeded under any operating condition. EP-B-0598144 employs a third, pH, electrode and the potentials of the three electrodes are controlled so as to avoid sulphiding. In addition to the disadvantage of cost of such a three-electrode system, the maximum rate of removal of silver is itself limited by the fact that the potential of the cathode is kept constant.

The generally cheaper two electrode control system relies on a knowledge of the cell currents and voltages to control the process. The most common method is to use a threshold level beyond which (above which for voltage, or below which for current) it is deemed no longer suitable to recover further silver. For example, when silver is recovered at a constant current, the plating voltage rises as the concentration of the silver in the solution falls—the voltage is reflecting both a change of conductivity in the solution and a change of the potentials of the cathode and anode. A disadvantage to this control method is that the threshold level that is chosen for switch off is not necessarily a suitable or even safe level for switching off under all operating conditions. This problem is exacerbated by the fact that each processor to which silver recovery is attached has a specific combination of operating parameters reflecting the variability in the concentration of the constituents of the solution arising from variation in:

(i) film exposure, and thus the proportion of silver that is removed by the fixer, (ii) film type, and thus the quantity of silver (the coated mass) available for development and fixing, (iii) film throughput, i.e. how much film is processed per hour, (iv) processor type, and thus (a) the amount of solution that is carried into the fixing stage from the preceding development stage, and (b) the amount of oxidation that takes place, (v) the chemical composition of replenisher solution used in the various stages of the processing, and (vi) the rate at which the processing solutions are replenished.

The specific combination of the above variables used by the operator of a given processing system is known as the 'operator profile'.

The voltage necessary to supply a certain current through a fixer solution at a given silver concentration, for example, will depend strongly on the pH of the solution, the concentration of the sulphite and/or thiosulphate in the solution, the temperature of the solution, and the rate at which it flows through the cell.

U.S. Pat. No. 4,619,749 overcomes the problems associated with setting reference voltage control thresholds which are valid for a wide variety of different solutions, by using calibration solutions with high and low silver concentration. The disadvantage of this approach is that the operator must obtain the reference solutions that are characteristic of his normal operating conditions, and then perform the calibration. GB-A-1500748 overcomes the problems associated with solution variability and the choice of suitable operating conditions common to two electrode systems, by employing a second electrolytic cell as a reference. The disadvantage of such a control system, however, is that it is inconvenient for the operator to use since the test cell has to be set up and employed for every solution from which it is desired to remove the silver. U.S. Pat. No. 3,925,184 employs a work counting method, which takes account of the silver entering the system as a result of film input and the silver leaving the system through plating reactions. The silver ion concentration in the fixer solution is estimated and a suitable current, based on a known relationship, is applied to the electrolytic cell. The disadvantage of this control method is that the amount of silver entering into the system has to be known accurately. In U.S. Pat. No. 3,980,538, a similar work counting method is employed in which the magnitude of the control current in the electrolytic cell is governed by the amount of charge on a capacitor that is intended to correspond to the quantity of silver present in the solution.

U.S. Pat. No. 4,776,931 discloses recovering metals from solutions by applying an intermittent plating voltage until the current drawn by the solution exceeds a predetermined threshold value above which the recovery system operates. U.S. Pat. No. 5,310,466 similarly operates using threshold values. Each of these systems has the disadvantages set out above of variability introduced by the operator.

U.S. Pat. No. 4,018,658 discloses a silver recovery system in which the voltage across the electrodes and the current passing between them are monitored, and the voltage is adjusted using a feedback loop so as to achieve the optimum current density. The system employs a predetermined voltage-current characteristic and is thus not able to adapt to any variation in the solution of the electrolytic cell.

EP-A-0201837 discloses a silver recovery process in which the electrolytic cell is operated at the plateau of the potential difference/current curve, that is to say at that point where the current is determined by the speed of diffusion of silver to the cathode surface. EP-A-0754780 is said to be an improvement on this system, in which that condition, referred to as the diffusion limitation current, is ascertained and the cell is then operated at a current density which is lower than the diffusion limitation current density. Amongst the ways proposed to determine the diffusion limitation current density, is mentioned the periodic measurement of a current-potential characteristic of the cell at a given silver concentration under de-silvering conditions. One such characteristic, although not a preferred one, is specified as being the curve of current versus the potential difference between the anode and the cathode, with a diffusion limitation current being determined by identifying the cell current when the second derivative of the current-potential characteristic is zero and the first derivative is minimal. The disadvantage of this system is the difficulty of obtaining a sufficiently accurate measurement of the diffusion-limited current by such a method.

PROBLEM TO BE SOLVED BY THE INVENTION

Applicants have realized that there is a requirement for a method of recovering metal from solution under more controlled conditions, and in particular whereby high current densities may be sustained for the longest times without unwanted side reactions. Furthermore, it is desirable to be able to maintain improved control of metal removal, that is to say to maintain recovery of the metal at high current efficiency, in operation even when the chemical conditions within the cell are changing. That is to say, it is desirable to provide a control method that can continually adapt to changes that are taking place in the cell.

It is also desirable to remove metal from solution without requiring the presence of a control electrode.

SUMMARY OF THE INVENTION

In accordance with one aspect of the present invention, there is provided a method of controlling the recovery of metal from solution flowing through an electrolytic cell by deposition onto a cathode thereof, comprising the steps of monitoring the rate of change in one of the (a) current flowing and (b) voltage difference between the cathode and an anode of the cell, due to variation in the concentration of the metal in the solution, and modifying the other of said current and voltage in response to said monitored rate of change thereby to control recovery of the metal from the solution.

The monitoring may be carried out in real-time, or by reference to stored values.

It will be appreciated that active modification of either the current or the voltage will consequentially result in a change in the other of them.

Preferably, whilst said one of the current and voltage is being monitored, the other is maintained at a substantially constant level.

Preferably the other of said current and voltage is reduced in response to determination of the magnitude of the rate of change of said one of the current and voltage reaching a maximum level.

Advantageously, a signal is derived that is indicative of whether or not the concentration of said metal in the solution in the cell is varied extraneously, and wherein the said rate of change is monitored only in the absence of such variation. The concentration of the metal in the solution flowing through the cell may be varied extraneously, for example in the context of photographic activity, by processing of film taking place in an associated tank whose solution is being fed to the cell, or by chemical replenishment of that tank. In the first instance, the concentration of metal in the cell would be increased, due to the input of metallic species, and in the second case decreased, due to dilution effects, by means other than recovery onto the plating cathode of the cell. The solution may be re-circulated between the electrolytic cell and a tank, preferably a tank of a photographic processor having fixing ability, and the indicating signal may be derived in response to activity of, preferably chemical operation within, the tank or of another stage of the processor. By 'chemical operation' is to be understood any chemical process that affects the metal concentration of the solution, e.g. fixing of silver halide photosensitive media. Alternatively, the solution may be re-circulated between the electrolytic cell and a tank, preferably a tank of a photographic processor having fixing ability, and a bypass may be provided for the solution such that its flow through the cell can be isolated from the tank, for example by closing valves in the pipes connecting the silver recovery unit to the processing tank, and the said change is monitored only under conditions of said isolation.

Preferably the rate of flow of the solution through, and/or the temperature of the solution in, the cell is monitored, and the value of the current or voltage as measured is adjusted in accordance with variation of the rate of flow and/or temperature.

Control of recovery of metal may be delayed until solution has been flowing through the cell for a predetermined time.

In a preferred method, the metal is silver and is recovered from a black and white photographic processing solution, for example a fixer solution, in the cell. It is to be appreciated, however, that the control of metal recovery in accordance with the present invention can be used not only with respect to black and white photographic processing solutions but also may be applicable to silver-containing processing solution or effluent, from color photographic processing solutions. With color photographic processing solutions, for example, a metallic species, such as iron, may be present in addition to the silver which it is desired to remove by deposition. Should the presence of another metallic species tend to interfere with the removal of a particular species by the method of the present invention, then measures will have to be taken to avoid, to eliminate, or otherwise to take into account the effect of that species.

In accordance with another aspect of the present invention, there is provided apparatus for controlling the recovery of metal from solution, wherein the solution is contained in an electrolytic cell having an anode and a cathode, comprising means for monitoring the rate of change in one of (a) the current flowing and (b) voltage difference between the cathode and the anode of the cell due to variation in the concentration of the metal in the solution, means for modifying the other of said current and voltage in response to said monitored rate of change, and means for controlling operation of the monitoring means and the modifying means.

ADVANTAGEOUS EFFECT OF THE INVENTION

The control over recovery of metal from solution in accordance with the present invention allows recovery at high current efficiency to be maintained under changing chemical conditions within the cell. In general the current efficiency, $\epsilon$, of a metal recovery reaction in an electrolytic cell may be defined as follows $$\varepsilon = \frac{\text{No. of moles of metal recovered} \times \text{No. of electrons transfered in the reaction}}{\text{No. of Faradays of charge passed}}$$

and therefore $$\varepsilon = \frac{nF(C_t - C_o)V}{MIt}$$

where n: The number of electrons transferred during reaction

F: Faraday's constant $C_t$: The concentration of metal species at time t $c_o$: The concentration of metal species at the start of the recovery process V: The volume of the solution M: The molar mass of the metal I: The recovery current t: The recovery period Thus, by utilizing the method of the invention, the operating condition of the electrolytic cell is noted at which it begins to lose its efficiency in recovering the metal from the solution. The current and/or voltage applied to the cell can then be appropriately adjusted so as to return the operating condition towards maximum current efficiency, so as to ensure this condition is maintained for as long a time as possible. This can be achieved for any particular processing profile adopted by an operator, can be carried out inexpensively and conveniently using only a two electrode arrangement, and, in the case of photographic solutions, can avoid sulphiding. Furthermore, this results in improved convenience of operation since the problems of electrical drift and fouling associated with three-electrode systems, and which would require the recalibration or replacement of any ancillary electrodes, are avoided.

BRIEF DESCRIPTION OF THE DRAWINGS

Methods of and apparatus for controlling the recovery of silver from a photographic fixing solution in an electrolytic cell, will now be described, by way of example, with reference to the accompanying drawings, in which.

DETAILED DESCRIPTION OF THE INVENTION

Figure 1:
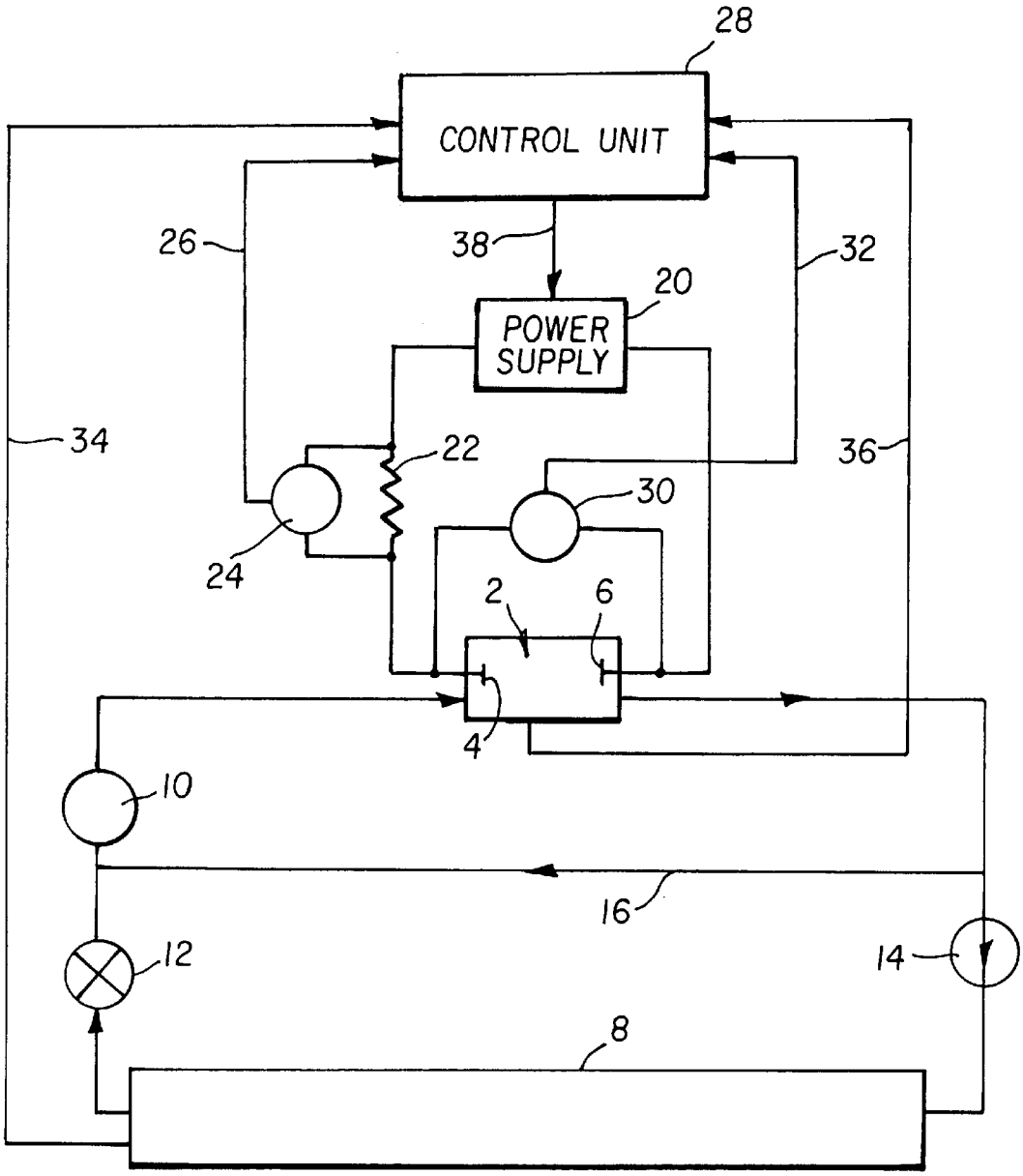
FIG. 1 is a schematic drawing of the cell and its associated electrical circuitry.

Referring to FIG. 1, an electrolytic cell 2 has an anode 4 and a cathode 6 of significantly larger surface area. Photographic fixer solution from a processing tank 8 is circulated through the cell 2 by a pump 10. The liquid flow between the tank 8 and the cell 2 can be isolated by means of a solenoid valve 12, a non-return valve 14 and a bypass pipe 16.

A constant current power supply 20 supplies power to the electrodes 4, 6 of the cell 2 via a measuring resistor 22 of known value. A voltmeter 24 is connected across the ends of the resistor 22 and sends a signal along line 26, representative of the current flowing through the cell 2, to a control unit 28. A voltmeter 30 is connected externally of the cell 2 across its electrodes 4 and 6, and sends a voltage signal along line 32 to the control unit 28. The control unit 28 also receives information along a signal line 34 from the fixer tank 8, and along a signal line 36 from the cell 2, representative of conditions therein. The control unit 28 sends control signals along line 38 to the power supply 20.

Figure 2:
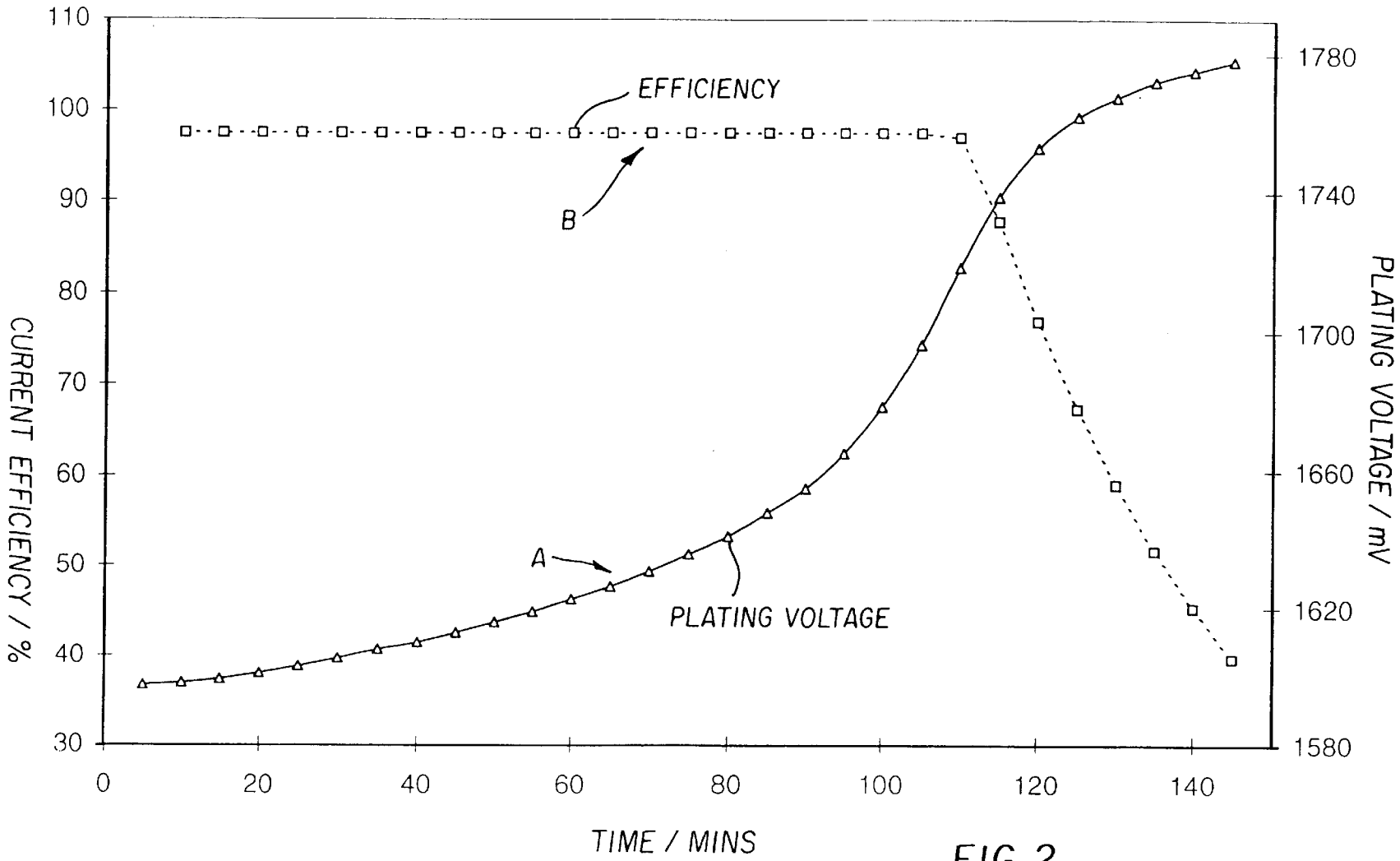
FIG. 2 is a graph showing a portion of curves of plating voltage and current efficiency versus time for the de-silvering of a seasoned black and white fixer solution.
Figure 3:
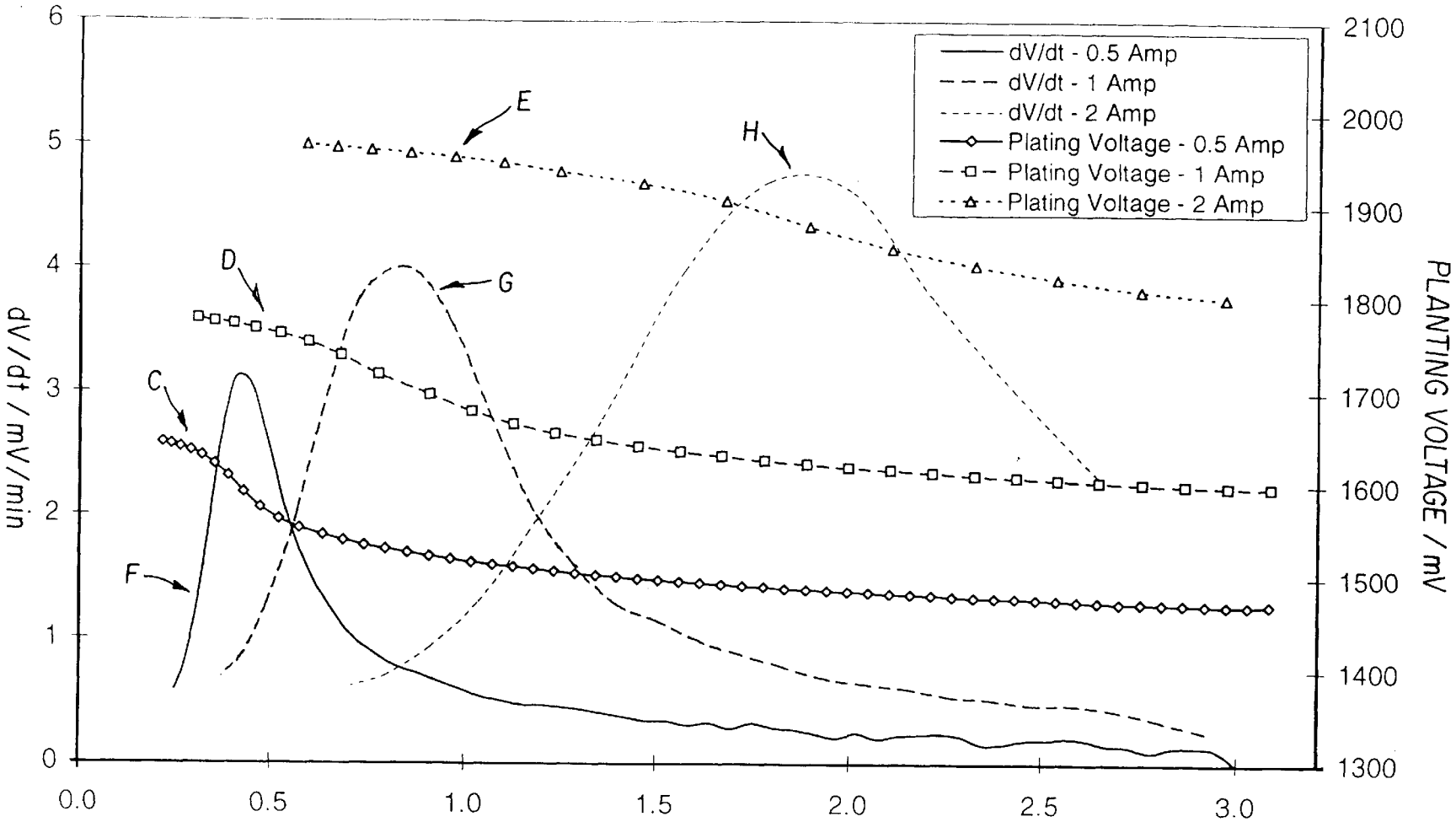
FIG. 3 is a graph showing curves of plating voltage, V, and its rate of change, dV/dt, versus silver concentration for the de-silvering of three identical batches of black and white fixer solution at various levels of constant current.

The curves of FIGS. 2 and 3 represent conditions in which no film is being processed nor replenisher being added.

FIG. 2 shows a portion of the curves of plating voltage A and current efficiency B versus time, for the de-silvering of a seasoned black and white fixer solution from the tank 8 as measured in the cell 2 at a constant current of 1 A. As silver is recovered from the fixing solution in the cell 2 on to the cathode 6, and thus as the concentration of silver in the cell 2 falls, a transition point is reached below which the current efficiency is reduced. The cell 2 is thus no longer operating at high current efficiency. The point at which the current efficiency starts to fall occurs at the inflection point of the curve A, that is to say at the point of maximum rate of change of the voltage across the electrodes 4, 6 of the cell 2.

One embodiment of the present invention provides a method in which the gradient of the curve A (dV/dt) is monitored, the maximum of this curve thus providing a clear indication of the point, that is to say operating conditions of the cell 2, at which loss of efficient recovery of the silver takes place. FIG. 3 shows a first set of curves C, D and E plotted against silver concentration (in grams per liter) of the plating voltage of the cell 2 for the de-silvering of three identical batches of seasoned black and white fixer solution at constant currents of 0.5 A (curve C), 1.0 A (curve D) and 2.0 A (curve E) respectively. FIG. 3 shows a second set of curves F, G and H, which correspond to the rate of change of plating voltage against time (dV/dt) for the curves C, D and E respectively.

It is to be noted that the slope of the curves of plating voltage versus silver concentration is always negative in a constant current control system. Thus, decreasing plating voltage at constant current implies increasing silver concentration. For a constant voltage control system, the slope of the plating current with silver concentration is always positive so that increasing current implies increasing silver concentration.

The circuitry within the control unit 28 is arranged to monitor curves such as F, G and H and to detect the peak thereof. Clearly, this will involve operating the cell slightly beyond the peak, that is to say the condition of maximum efficiency of recovery of the silver, so that it can be ensured that the peak really has been reached. The control unit 28 then operates on the power source 20 via line 38 to reduce the current supplied to the cell 2 to a lower level, which may be a pre-set value, or, if the lowest chosen operating current has been reached, to turn off the plating process.

It has been found from experiment that a peak in the gradient curve is observed for all operating conditions and fixer solutions of a photoprocessor. The current through the electrolytic cell may be turned down or turned off completely when the peak is detected, and thus avoid unwanted side reactions, since the point of change in current level in every case is linked to the loss of high plating efficiency for that set of conditions. Turning up the current would be achieved by monitoring the voltage at constant current. If the voltage is found to be decreasing, this can be taken to indicate that silver is entering the system at a greater rate than that at which it is being removed. Accordingly, the level of the plating current may be increased by small increments. Other methods of controlling the increase in plating current are disclosed in our contemporaneously-filed patent application Ser. No. 9,815,168.1.

The processing of photographic material in the fixer tank 8 adds silver to the solution in the cell 2. Also, the addition of replenishment chemicals to the fixer tank 8 will correspondingly reduce the silver concentration. Each of these two effects would cause an extraneous change in the voltage across the electrodes 4, 6 of the cell 2. Thus operation of this method on the cell 2 should preferably be done only when no film is being processed or replenishment is being carried out within the tank 8. To facilitate this, in response to a signal along the line 34 from the fixer tank 8, the control unit 28 may be arranged to disregard data of current and voltage relating to silver recovery within the cell 2 during unfavorable conditions. Alternatively, the information supplied along the signal line 34 may be used by the control unit 28 to close the solenoid valve 12 and thus to isolate the cell 2 from the fixer tank 8. Gathering of data relating to de-silvering of the solution in the closed loop formed by the cell 2, pump 10 and by-pass pipe 16 may therefore continue.

This invention thus enables the use of high metal recovery rates at high current efficiency, avoiding unwanted side reactions such as sulphiding. This is achieved by arranging for the current, or voltage, to be increased or decreased according to the changing silver concentration in the solution in order to maintain the maximum current efficiency of recovering metal from the solution and ultimately of being switched off when that can no longer advantageously be sustained.

The embodiment of the invention described with reference to FIGS. 2 and 3 refers to monitoring of the voltage and detecting a maximum in its rate of change at constant current. However, it will be appreciated that, correspondingly, the voltage may be held constant and a minimum in the rate of change of the current may be detected. In each case, it is the magnitude of the greatest rate of change that is detected.

Once a peak in the rate of change of plating voltage (dV/dt), or in the rate of change of plating current (dI/dt), has been found, the values of the plating voltage and current at the peak position can be stored in computer memory as a look-up-table (LUT). These values can now be used as "threshold" levels by the control system, the benefit being that the threshold has been derived for the specific solution and flow conditions present in the cell.

For example, using part of the same batch of seasoned fixer as was used to produce the curves C, D and E, desilvering is started at a silver concentration of 3 g/1 using a constant current of 2 A. At this silver concentration and plating current, operation is in the region with respect to the inflexion point in the curve E in which plating at high current efficiency is achieved. As silver is removed from the batch of fixer, the voltage will follow curve E and the rate of change of plating voltage with time will follow curve H. The plating voltage at which the peak value of dV/dt occurs is 1.876V. When the peak is detected by the control system, the plating current is reduced to a lower level of 1 A, to maintain high current efficiency in the cell. After a short period in which initial switching transients are allowed to settle, the new plating voltage is determined to be 1.622V (see curve D at the same silver concentration as the peak of curve H). The two pairs of plating current and voltage values at the silver concentration corresponding to the 2 A peak for the 2 A and 1 A current levels are stored in the LUT. These values are specific to the actual solution component concentrations, flow conditions and temperature that were present when the peak was detected.

The stored values may be used subsequently for increasing and decreasing the plating current. For example, the plating voltage and current might be 1.645V and 1 A respectively when a large batch of film starts to be processed. The silver concentration in the tank rises and so causes the plating voltage to decrease (see curve D). When the voltage decreases below 1.622V, the value in the LUT corresponding to the silver concentration at which the transition in current efficiency at 2 A plating current occurs, it is possible to increase the plating current to 2 A and maintain a high current efficiency. The plating current is then increased to 2 A to maximize the recovery rate of silver and so to maintain a low silver concentration in the processing tank.

The LUT may be further used to store values of dV/dt for a given plating current (or dI/dt for a given plating voltage) against plating voltage (plating current) under conditions either of isolation of the cell from the tank or else of no film processing and addition of replenisher to the tank. The stored information thus enables more accurate determination of the position of the peak by using curve fitting and more sophisticated peak detection algorithms. It also permits, based on past knowledge of the curve shape, the prediction of peak position in advance of reaching it, so that the plating current may be reduced before the peak is passed. This approach ensures plating at high current efficiencies is maintained without compromise by the requirement of having to pass the peak in order to detect it in real-time.

The values of plating current and voltage stored in the LUT should be regularly updated to follow the changing solution concentrations in the tank and flow conditions in the cell due to tank seasoning effects, and variation in parameters of the operator profile due to increasing silver thickness on the cathode. In this way, the "voltage threshold levels" stored in the LUT are optimized to match changing solution and cell conditions.

Furthermore, another location in the LUT may be used to store the last known values of plating current and voltage. With this information, the LUT may also be used to detect sudden changes in plating conditions as might occur for example when a tank is drained and filled with fresh solution. Normally, the silver recovery unit would be switched off during draining and refilling of a tank. In this case, when the silver recovery unit is next switched on, the plating voltage at the same plating current last used before switch off would not correspond to the last known plating voltage. The control system would then reset all the values stored in the LUT and build them up again over time as the silver concentration in the tank permits the use of the whole range of plating current bands.

It has been found that although control of the recovery of metal from a solution in accordance with the invention can be carried out over a wide range of flow conditions, higher flow rates are preferred. The higher the flow rate, the better is the agitation of the solution in the cell 2, especially at the boundary layer of the cathode 6. Thus, by employing higher flow rates for metal recovery at a given current, the concentration of the metal can be reduced to a lower level at high current efficient recovery.

Furthermore, it has been found that using solutions having a higher pH value, a greater dynamic range is obtained in the curve of the rate of change of the voltage, or current versus time, and the peak is of a greater height for a common background level. Furthermore, the position of the peak is also affected, and is shifted to lower metal concentrations as the pH value increases. Use of a higher pH solution in the electrolytic cell 2 thus allows the metal to be recovered down to lower concentrations without loss of efficiency and whilst providing greater signal-to-noise ratios.

It is known that the rate of flow of the solution through the cell 2 has a great effect on the voltage that is required to be applied across the electrodes 4, 6 thereof in order to maintain the current therethrough at a constant value. Accordingly, the flow may be arranged to be monitored, by means of a flow sensor in the pipework, or by means of the back EMF of the pump 10, so that a correction can be made in the control algorithms of the control unit 28 to account for short term fluctuation in the flow rate. Similarly, the temperature of the solution affects the plating voltage in the cell 2 and corresponding corrections can be made via the control unit 28. Information in respect of these corrections may be sent from the cell 2 to the control unit 28 along the signal line 36. It will be appreciated that monitoring the temperature of the solution in the cell 2 in this way allows the control system to be operated more accurately and in particular when the photographic processor has been turned off and during periods of cooling or warming of the solution shortly after turn off or turn on respectively.

An input signal to the control unit 28 from the photographic processor, for example along the signal line 34 from the fixer tank 8, provides extra safety for the operation of the metal recovery cell 2 when switching on or when increasing the value of the current through the cell. Such a signal will, for example, indicate that photographic material is present in the system and consequentially that it is very likely that silver has entered into the solution. When starting with a fresh fixer solution, for example, where the risk of sulphiding of the cell 2 is increased, the control unit 28 can ensure that the cell 2 is not brought into operation until at least some photographic material has been processed.

The control unit 28 can also be arranged to ignore current and voltage measurements during a period in which transient behavior is taking place, for example when the system is used for the first time either with a new or silver-laden cathode, or if a change of current level is made. The accuracy and efficiency of the silver recovery is thus controlled.

The invention has been described in detail with particular reference to certain preferred embodiments thereof, but it will be understood that variations and modifications can be effected within the spirit and scope of the invention.

We claim:

1. A method of controlling the recovery of metal from solution flowing through an electrolytic cell by deposition onto a cathode thereof, comprising the steps of monitoring the rate of change in one of the (a) current flowing and (b) voltage difference between the cathode and an anode of the cell, due to variation in the concentration of the metal in the solution, and modifying the other of said current and voltage in response to said monitored rate of change thereby to control recovery of the metal from the solution.

2. A method according to claim 1, wherein whilst said one of the current and voltage is being monitored, the other is maintained at a substantially constant level.

3. A method according to claim 1 wherein the other of said current and voltage is reduced in response to determination of the magnitude of the rate of change of said one of the current and voltage reaching a maximum level.

4. A method according to claim 1 wherein a signal is derived that is indicative of whether or not the concentration of metal in the solution in the cell is varied extraneously, and wherein the said rate of change is monitored only in the absence of such variation.

5. A method according to claim 4, wherein the solution is recirculated between the electrolytic cell and a tank, and wherein the indicating signal is derived in response to chemical activity within the tank.

6. A method according to claim 1, wherein the solution is recirculated between the electrolytic cell and a tank, and wherein a bypass is provided for the solution such that its flow through the cell can be isolated from the tank, and wherein the said rate of change is monitored only under conditions of said isolation.

7. A method according to claim 1, comprising the step of storing in storage means the values of the voltage and the current at which the maximum value of the magnitude of the rate of the change of said one of the current and voltage is reached under conditions in which the concentration of metal in the solution is not varied extraneously, and modifying by reducing the other of said current and voltage on or before reaching both the stored values subsequently under conditions of reducing metal concentration.

8. A method according to claim 7 wherein the reduced values of the current and voltage are stored in said storage means, and wherein the other of said current and voltage is modified by being increased on or after reaching both the reduced stored values subsequently under conditions of increasing concentration of the metal in the solution.

9. A method according to claim 1, comprising the step of storing in said storage means values of voltage, current and the rate of change of said one of the current and voltage, wherein said stored values are used to determine the values of the current and voltage under which the magnitude of the said rate of change is a maximum, and wherein the other of said current and voltage is modified by being reduced on or before reaching the said maximum.

10. A method according to claim 8 wherein the reduced values of the current and voltage are stored in said storage means, and wherein the other of said current and voltage is modified by being increased on or after reaching both the reduced stored values subsequently under conditions of increasing concentration of the metal in the solution.

11. A method according to claim 1 wherein the values of current and voltage are repeatedly stored, and wherein in response to any significant change between successive stored values, all the values stored in said storage means are reset to predetermined values.

12. A method according to claim 1, wherein at least one of the rate of flow of the solution through, and the temperature of the solution in, the cell is monitored, and wherein the value of the current or voltage as measured is adjusted in accordance with variation of the rate of flow and/or temperature.

13. A method according to claim 1, wherein activation of said control of recovery of metal is delayed until solution has been flowing through the cell for a predetermined time.

14. A method according to claim 1, wherein the metal is silver and is recovered from a photographic processing solution in the cell.

15. Apparatus for controlling recovery of metal from solution, wherein the solution is contained in an electrolytic cell having an anode and a cathode, comprising means for monitoring the rate of change in one of (a) the current flowing and (b) voltage difference between the cathode and the anode of the cell due to variation in the concentration of the metal in the solution, means for modifying the other of said current and voltage in response to said monitored rate of change, and means for controlling operation of the monitoring means and the modifying means.

16. Apparatus according to claim 15, comprising inlet means for supplying the solution to the cell, means for isolating the supply from the cell, and means for enabling the monitoring means only subsequent to isolation of the supply from the cell.

17. Apparatus according to claim 15, comprising storage means for storing the values of the voltage and current at which the maximum value of the magnitude of the rate of change of said one of the current and voltage is reached under conditions in which the concentration of metal in the solution in the cell is not varied extraneously, and wherein the means for modifying the other of said current and voltage is arranged to effect a reduction therein when or before both stored values are reached subsequently under conditions of decreasing concentration of the metal in the solution.

18. Apparatus according to claim 17, wherein the storage means is arranged to store the reduced values of the current and voltage, and wherein the means for modifying the other of said current and voltage is arranged to effect an increase therein when or after both reduced stored values are reached subsequently under conditions of increasing concentration of the metal in the solution.

19. Apparatus according to claim 17, wherein the storage means is arranged to store values of voltage, current and the rate of change of said one of the voltage and current, wherein means is provided for determining from said stored values the values thereof at which the magnitude of the said rate of change is a maximum, and wherein the means for modifying reduces the other of said current and voltage when or before the said maximum is reached.

20. Apparatus according to claim 17, wherein the storage means is arranged repeatedly to store values of current and voltage, wherein means is provided for determining whether there is a significant change between successive stored values, and wherein in response to detection of a significant change, all the values stored in the storage means are reset to predetermined values.

* * * * *